US007297126B2

(12) United States Patent
Kries

(10) Patent No.: US 7,297,126 B2
(45) Date of Patent: Nov. 20, 2007

(54) PORTABLE FOOT AND WRIST MASSAGER

(75) Inventor: Gary W. Kries, Isleton, CA (US)

(73) Assignee: Ronald L. Grose, Lodi, CA (US), partial interest ( * ) Notice: Subject to any disclaimer, the term of this patent is extended or adjusted under 35 U.S.C. 154(b) by 462 days.

(21) Appl. No.: 11/081,285

(22) Filed: Mar. 15, 2005

(65) Prior Publication Data

US 2006/0211960 A1 Sep. 21, 2006

(51) Int. Cl.
*A61H 1/00* (2006.01)

(52) U.S. Cl. ..... 601/57; 601/30; 601/49; 601/56; 5/915

(58) Field of Classification Search ..... 601/15, 601/27, 30, 31, 46, 49, 53, 56, 57, 58, 59, 601/61, 66, 69, 70; 5/694, 915
See application file for complete search history.

(56) References Cited

U.S. PATENT DOCUMENTS 4,326,506 A 4/1982 Kawabata
4,802,463 A 2/1989 Rojas
4,979,502 A 12/1990 Hunt
4,989,584 A * 2/1991 Simon ..... 601/70
5,007,410 A * 4/1991 DeLaney ..... 601/53
5,188,095 A * 2/1993 Healy ..... 601/61
5,334,131 A 8/1994 Omandam et al.
5,599,280 A 2/1997 Wolden
5,807,287 A 9/1998 Cheng
6,537,235 B1 3/2003 Connor et al.

* cited by examiner

*Primary Examiner*—Quang D. Thanh
(74) *Attorney, Agent, or Firm*—R. Michael West

(57) ABSTRACT

A portable massager adaptable for foot and wrist applications. An elongated resonator plate is formed from a plurality of contiguous hollow flutes oriented in a longitudinal direction. One or more vibrator cutouts are provided in the resonator plate, passing from its upper side to its lower side. A vibrator, preferably capable of operating from low voltage DC, nests within each cutout. A lower sheet covers the lower side of the resonator plate and lower face of the vibrator. An upper sheet accommodates the upper face of the vibrator and covers at least a portion of the upper side of the resonator plate. Top and bottom vinyl covers encase the massager construction. A vibrator control switch may be included in the power line extending from an external electrical connector to the vibrator. The massager may be powered by a wall transformer or by alternative mobile power sources.

20 Claims, 3 Drawing Sheets

PORTABLE FOOT AND WRIST MASSAGER

BACKGROUND OF THE INVENTION

1. Field of the Invention

The invention relates generally to electrically powered massaging devices. More particularly, the invention pertains to a portable foot or wrist massager including an internal resonating plate provided with a plurality of contiguous hollow flutes to enhance the effectiveness of the massager's vibrators.

2. Description of the Prior Art

The prior art shows a variety of electrically powered massaging devices which are adapted both for therapeutic uses and for general relaxation. Some massagers are designed for more general use, such as a mattress to lie upon. For example, vibratory mats or pads are shown in U.S. Pat. No. 4,326,506, issued to Kawabata and in U.S. Pat. No. 5,807,287, granted to Cheng. Other massaging devices are adapted to cover or wrap around particular parts of the body. U.S. Pat. No. 4,979,502 to Hunt, shows combined massage and heating devices particularly adapted for the chest, waist, arm and legs. A strap-on massager for the leg is disclosed in U.S. Pat. No. 5,334,131, issued to Omandam et al. A foot massager is shown in U.S. Pat. No. 4,802,463, granted to Rojas. And, a scarf with an electrically operated massager is taught in U.S. Pat. No. 6,537,235 issued to Connor et al. Lastly, in U.S. Pat. No. 5,599,280 granted to Wolden, a therapeutic wrist device having vibration and heat is illustrated.

However, there is a need for a massager which may be adapted to massage both the feet and the wrists of the human body, using very similar construction techniques.

There is also a need for a massager having high and substantially uniform vibratory output across its working surface.

There is also a need for a portable massager which may be powered by different power sources readily available at home, in the office, in an automobile or in connection with other modes of transportation.

These and other objects of the present invention will be described in the drawings and in the detailed description of the preferred embodiment set forth below.

SUMMARY OF THE INVENTION

The invention comprises a portable electrically powered massager, which may be constructed either for foot massaging or for wrist massaging applications. The massager includes an elongated resonator plate in its core. The resonator plate is formed from a plurality of contiguous hollow flutes, oriented in the longitudinal aspect of the resonator plate. The resonator plate is manufactured from substantially rigid plastic material, to enhance the transmissivity of vibratory waves. At least one vibrator cutout is provided in the resonator plate, passing from its upper side to its lower side.

A vibrator is snugly positioned within the vibrator cutout so that vibrations are directly coupled to the resonator plate. A cutout cover, slightly larger than the cutout itself, may be glued over the bottom of the vibrator and the adjacent portion of the resonator plate. A lower sheet, preferably manufactured from foam, covers the lower side of the resonator plate and the cutout cover. An upper sheet, also preferably manufactured from foam material, may also include a cutout to accommodate the upper face of the vibrator. The upper sheet covers at least a portion of the upper side of the resonator plate, generally surrounding the vibrators. Top and bottom vinyl or cloth covers are provided to encase the entirety of the massager components.

A control switch may be mounted inside the vibrator, and is series-connected within the power line extending from an external electrical connector to the vibrators. The external electrical connector, in turn, is detachably connected to a power line extension. The power line extension may lead to a small wall transformer, for home or office use, or to a cigarette lighter plug, for portable or field use, such as in an automobile or other vehicle.

DETAILED DESCRIPTION OF THE PREFERRED EMBODIMENT

Figure 1:
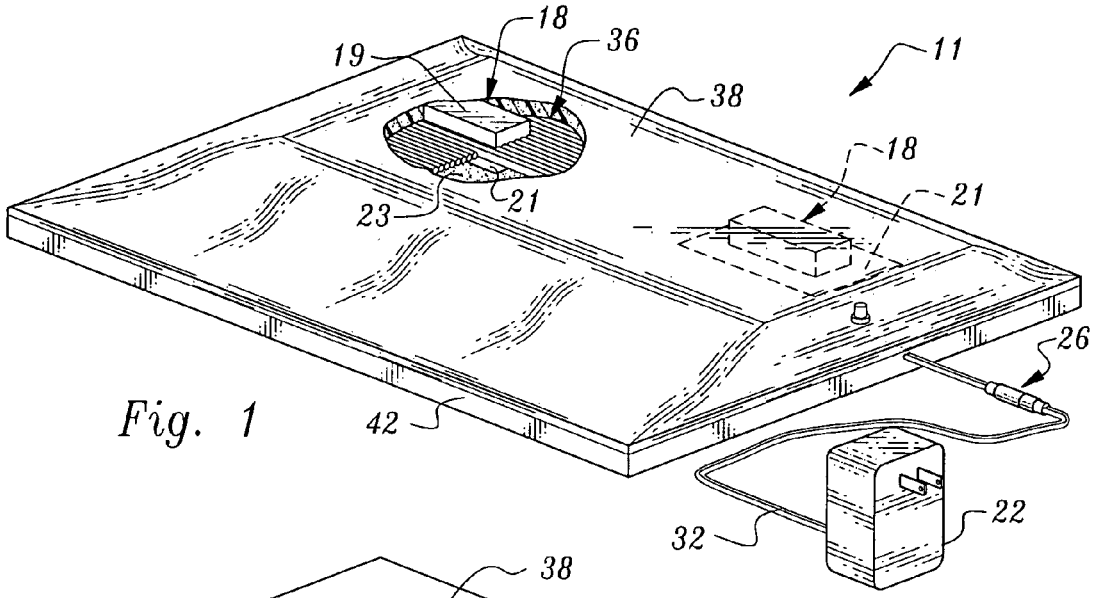
FIG. 1 is a perspective view of the massager of the present invention, a portion of the cover, the upper sheet, and the resonator plate being broken away to show inner details.
Figure 5:
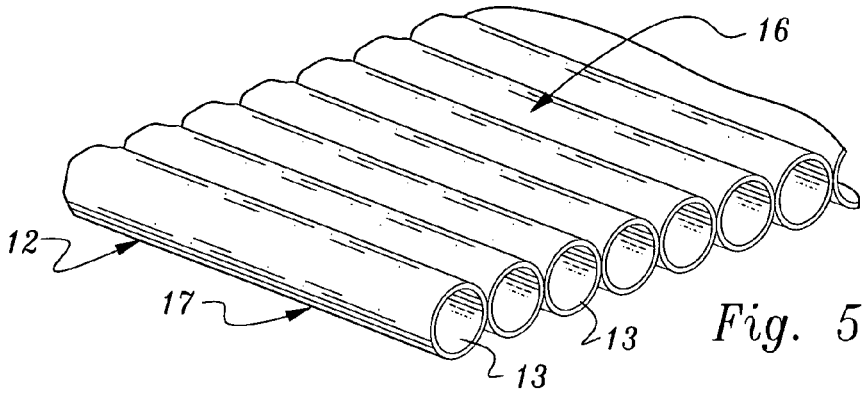
FIG. 5 is fragmentary, perspective view taken to an enlarged scale, showing the contiguous hollow flutes in the resonator plate.

The portable massager 11 of the present invention, sized and configured for the application of massaging feet, is shown in FIG. 1. Although not critical, a longitudinal dimension of 16", or so, and a transverse dimension of 12", or so, are suitable to accommodate the feet of most 20 people. Such dimension are also not so large as to make the massager 11 unwieldy to handle or transport. At the core of the massager 11 is an elongated resonator plate 12. As is shown most clearly in FIGS. 5 and 6, plate 12 includes plurality of contiguous, hollow flutes 13. It is significant to note that flutes 13 are oriented in the longitudinal direction or aspect of plate 12. The flutes have a uniform diameter, and may range in size from approximately 1/16" to 1/2". Relatively thin and planar, plate 12 is preferably manufactured from a substantially rigid but lightweight material, such as plastic. Other materials may also be suitable for plate 12, providing they can be formed to include the plurality of flutes or equivalent structure, and are sufficiently rigid to transmit vibratory waves effectively.

Figure 2:
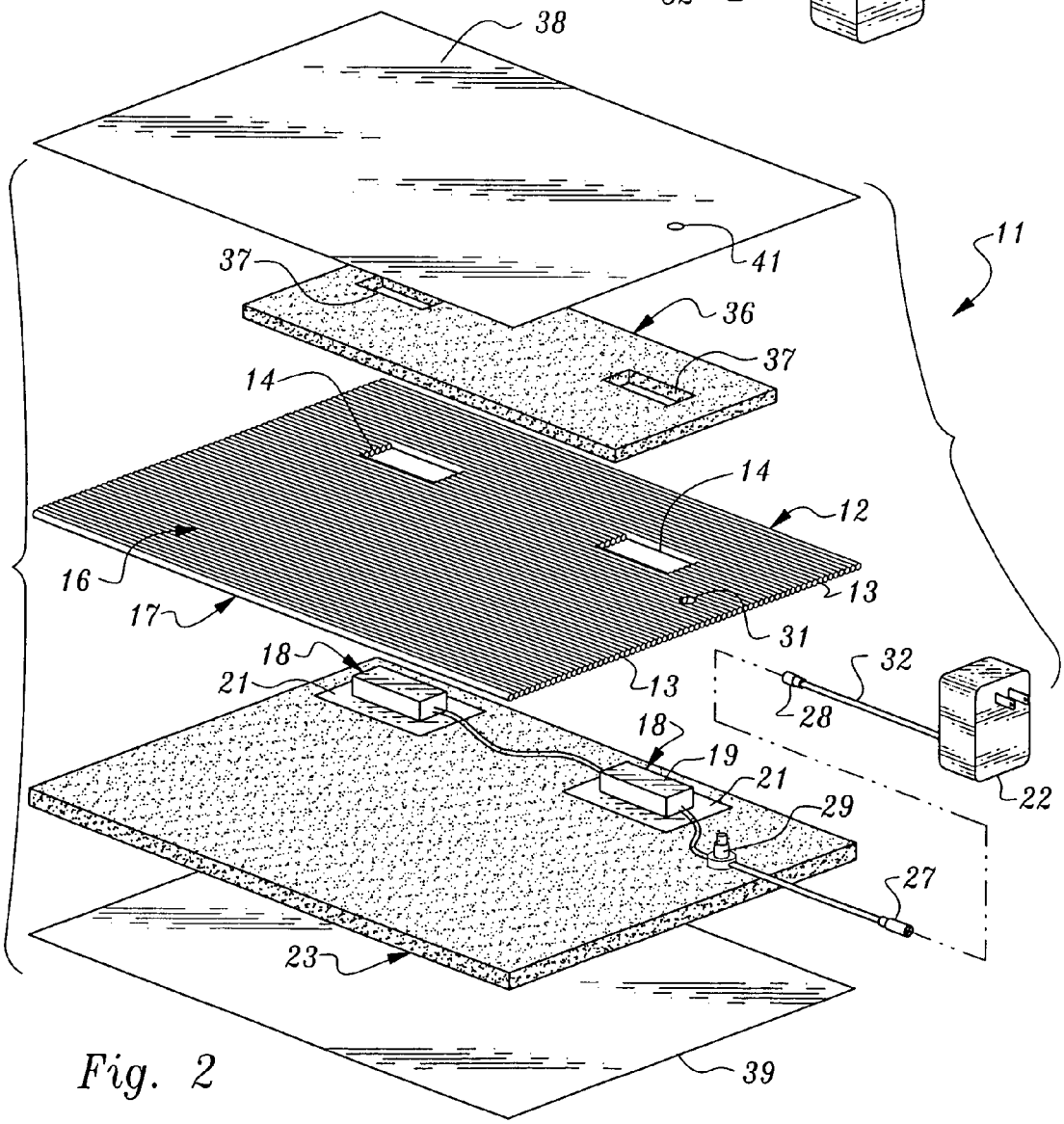
FIG. 2 is an exploded perspective view of the foot massager of FIG. 1, showing the top and bottom covers, the upper and lower sheets, the resonator plate and the two vibrators.
Figure 3:
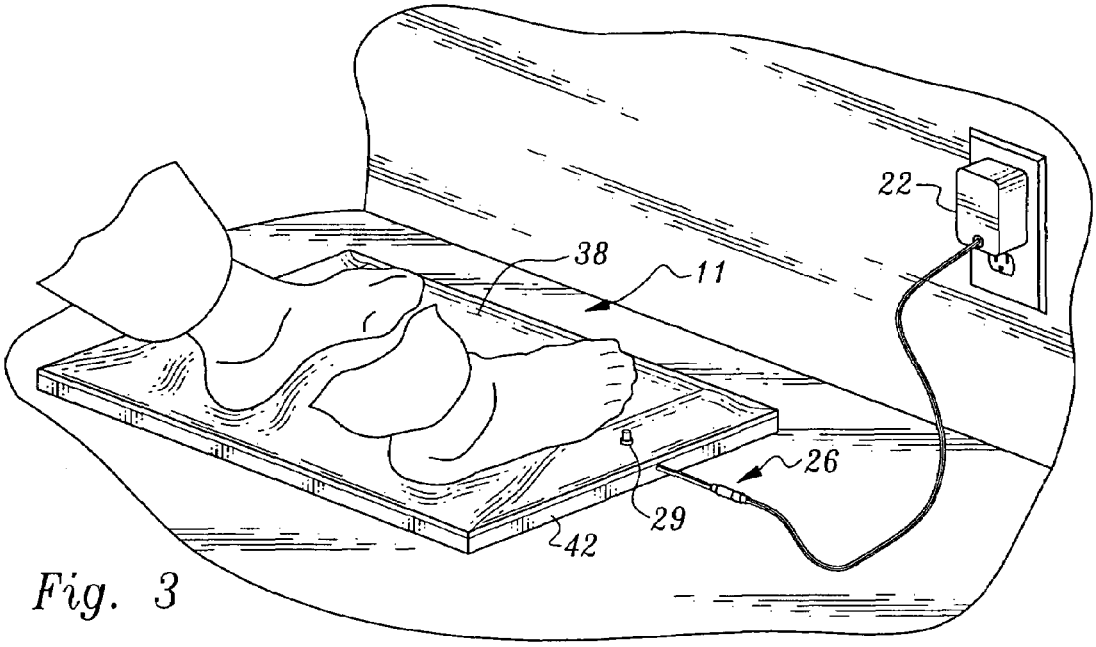
FIG. 3 is a perspective view showing the foot massager in a typical office or home use, being powered by a wall transformer.
Figure 6:
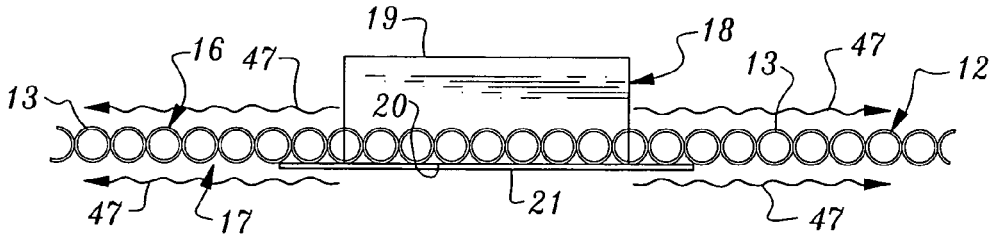
FIG. 6 is a fragmentary, end elevational view taken of the resonator plate and a vibrator, showing the waves transferring vibratory energy from the vibrator throughout the resonator plate.

At least one vibrator cutout 14 is provided in the resonator plate 12, passing from its upper side 16 to its lower side 17. Preferably, two vibrator cutouts 14 are used in most applications, as shown in FIG. 2. A conventional electric vibrator 18 nests within each of the vibrator cutouts 14. The plan dimensions of the vibrators are such that they fit snugly within the cutouts 14, providing effective coupling of the case vibrations to the structure of the resonance plate 12. As shown in FIG. 6, the height of the vibrator 18 is such that its upper face 19 extends beyond the plane of the upper side 16 of the resonator plate 12. And, the lower face 20 of the vibrator 18 is co-planar with the lower side 17 of plate 12.

A cutout cover 21 may be provided for additional support for the vibrator, and to enhance vibratory coupling between the vibrator 18 and the resonance plate 12. Cutout cover 21 is slightly larger than the plan dimensions of the cutout 14, and may be glued to the bottom of the vibrator and the lower side of the resonator plate immediately surrounding the cutout 14.

Vibrators 18 are preferably capable of operating from low voltage DC, in the range of approximately 3-24 volts. This capability will enable the massager 11 to be operated from a variety of readily available wall transformers 22 which typically convert 120 volts AC to low voltage DC. Such a capability will also enable the massager to operate from the nominal 12 volts DC which is available in automobiles, boats, and some trains and airplanes. Solar cells and low voltage power packs also provide 12 volts DC for operation of the massager. However, higher operating voltages or operation from alternating current is also possible by simply using vibrators of different operating specifications for the massager 11.

Figure 4:
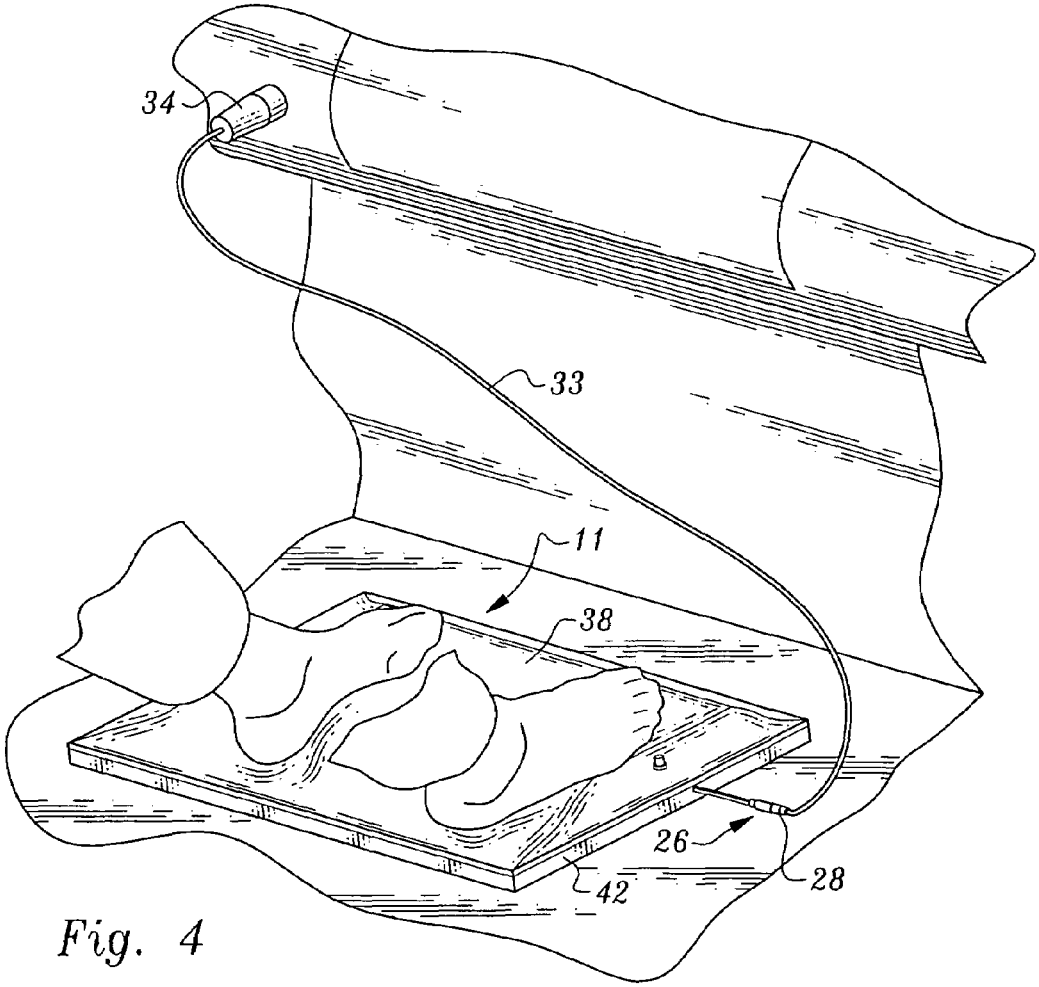
FIG. 4 is a perspective view showing the foot massager in an automobile, being powered by the power line extension connected to a cigarette lighter socket.

A lower sheet 23 covers the lower side 17 of the resonator plate 12 and cutout covers 21. Lower sheet 23 is preferably constructed from foam, or other resilient material. A power line 24 extends from each vibrator 18 to an external connector 26, having a female end 27 and a male end 28. A push-button switch 29 is series-connected within power line 24, so that the user may selectively control the operation of the vibrators 18. The base of switch 29 is adhesively attached to the upper side of lower sheet 23. The control button of switch 29 passes through an aperture 31 in resonator plate 12. A power line extension 32 connects male end 28 to wall transformer 22. Alternatively, for portable operation, such as in a motor vehicle, a power line extension 33 may be provided, connecting male end 28 to a standard cigarette lighter plug 34. (See, FIG. 4).

An upper sheet 36, also made from foam or other resilient material, includes two vibrator cutouts 37, sized, configured, and located to accommodate the upper faces 19 of vibrators 18. Upper sheet 36 covers at least a portion of the upper side 16 of the resonator plate 12, generally in the vicinity of the vibrators 18. The portion of upper side 16 which is not covered by upper sheet 36, allows the user of the massager to enjoy substantially direct contact with the vibrating resonator plate 12.

Massager 11 also includes a top cover 38 and a bottom cover 39, encasing its operative components. Covers 38 and 39 may be manufactured from either vinyl, leather, or fabric, as required. Top cover 38 is co-extensive with the upper sheet 36 and the remaining uncovered upper side 16 of resonator plate 12. Top cover 38 includes an aperture 41 to pass the control button of switch 29. As shown in FIG. 2, bottom cover 39 is co-extensive with the lower sheet 23. Top cover 38 and bottom cover including peripheral edges connected to form a peripheral seam 42.

Figure 7:
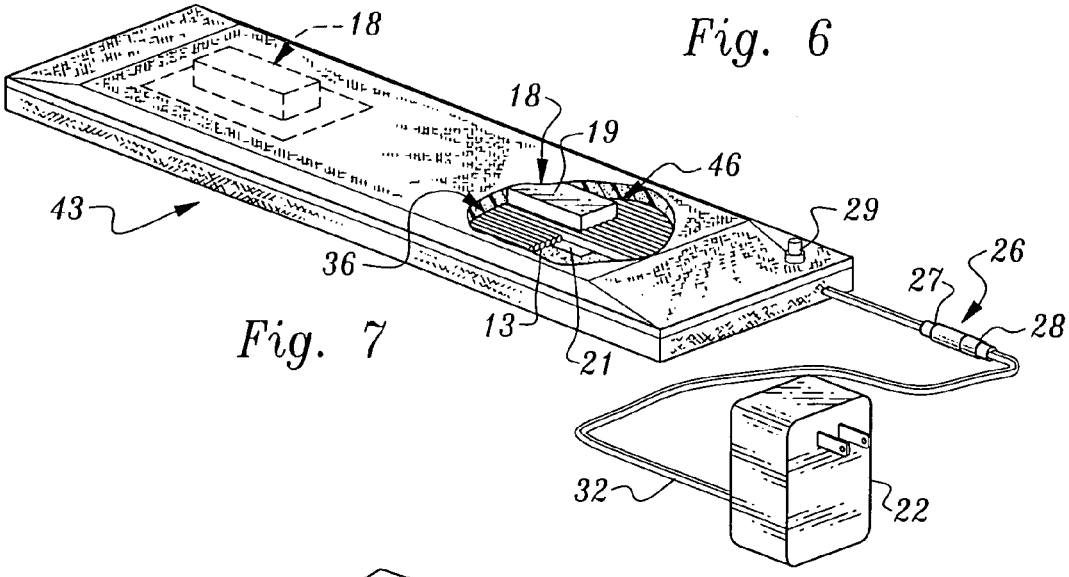
FIG. 7 is a perspective view of the massager of the present invention, configured as a wrist massager, a portion of the cover, the upper sheet and the resonator plate being broken away to show inner details of construction; and, FIG. 8 is a perspective view of the wrist massager being employed at a computer workstation, using an external wall transformer as a power supply.
Figure 8:
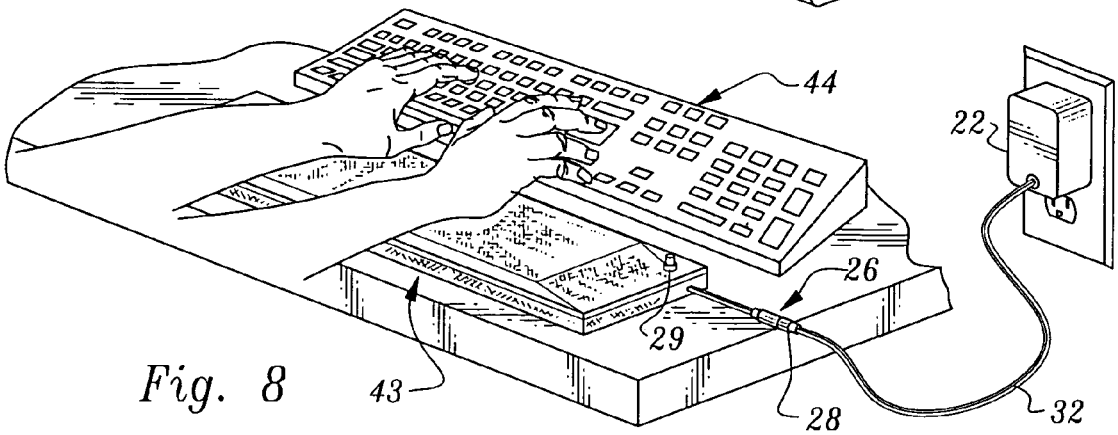

For the purpose of massaging a user's wrists, while working at a computer station or the like, a massager 43 is disclosed in FIGS. 7 and 8. Except for its overall plan dimensions, massager 43 is constructed virtually identically to the massager 11 described above. Massager 43 is sized and configured to accommodate the wrist and lower palms of a user, while working at a computer keyboard 44. As such, massager 43 may be approximately 15", or so, in its longitudinal dimension, and approximately 4", or so, in its transverse dimension. Massager 43 also includes a pair of vibrators 18, mounted within and coupled to a resonator plate 46 of the appropriate dimensions. As with massager 11, the flutes 13 of resonator plate 46 in massager 43 are oriented in the longitudinal direction or aspect of plate 46. Because in all other respects, massager 43 is identical to massager 11, no further explanation regarding its structural features need be provided.

In operation, both massagers enjoy the same enhanced performance, provided principally by their respective resonator plates 12 and 46 in combination with associated vibratory mechanisms. FIG. 6 depicts the unique coupling and transmission of vibratory waves 47, provided by the resonator plates of the present invention. The contiguous, hollow flutes, oriented in the longitudinal direction or aspect of the massager, are effective to distribute the vibratory waves 47 both transversely and longitudinally throughout the massager's operating surface. As a consequence, efficient and uniform distribution of the vibratory waves throughout the massager is effected, to the enjoyment of the user.

What is claimed is:

1. A portable massager comprising:

a. an elongated resonator plate, said plate including a plurality of contiguous hollow flutes oriented in a longitudinal direction, said plate further including at least one vibrator cutout passing from an upper side to a lower side thereof;

b. an electric vibrator, said vibrator being sized and configured to fit within said cutout of said resonator plate;

c. a lower sheet of resilient material, said lower sheet covering said lower side of said resonator plate and supporting a lower face of said vibrator; and, d. an upper sheet of resilient material, said upper sheet covering an upper face of said vibrator and at least a portion of said upper side of said resonator plate.

2. A massager as in claim 1 further including a top cover co-extensive with and covering said upper sheet and said upper side of said resonator plate, and a bottom cover co-extensive with and covering said lower sheet, said top cover and said bottom cover including peripheral edges connected to form a peripheral seam.

3. A massager as in claim 1 in which said resonator plate is formed from a substantially rigid plastic material.

4. A massager as in claim 3 in which said flutes have a uniform diameter within the range of 1/16" to 1/2".

5. A massager as in claim 1 in which a power line extends from said vibrator to a power supply external to the massager.

6. A massager as in claim 5 in which said vibrator is powered by a DC voltage in the range of approximately 3 to 24 volts, and in which said power supply is a wall transformer.

7. A massager as in claim 5 in which a vibrator control switch is provided in said power line, and in which a detachable electrical connector is provided at an end of said power line external to said massager.

8. A massager as in claim 7 in which one end of a power extension cord is connected to said electrical connector and the other end of said power extension cord includes an automobile cigarette lighter plug.

9. A massager as in claim 1 having an elongated dimension and a transverse dimension so as to accommodate two feet resting thereon.

10. A massager as in claim 1 having an elongated dimension and a transverse dimension so as to accommodate two wrists resting thereon.

11. A portable massager comprising:

a. an elongated resonator plate, said plate including a plurality of contiguous hollow flutes oriented in a longitudinal direction, said plate further including a pair of vibrator cutouts passing from an upper side to a lower side thereof;

b. a pair of electric vibrators, said vibrators being sized and configured to fit within said cutouts of said resonator plate, each of said vibrators having a lower face and an upper face;

c. a lower sheet of resilient material, said lower sheet covering said lower side of said resonator plate and supporting said lower faces of said vibrators;

d. an upper sheet of resilient material, said upper sheet covering said upper faces of said vibrators and at least a portion of said upper side of said resonator plate; and, e. a top cover co-extensive with and covering said upper sheet and said upper side of said resonator plate, and a bottom cover co-extensive with and covering said lower sheet, said top cover and said bottom cover including peripheral edges connected to form a peripheral seam.

12. A massager as in claim 11 in which said resonator plate is formed from a substantially rigid plastic material.

13. A massager as in claim 12 in which said flutes have a uniform diameter within the range of 1/16" to 1/2".

14. A massager as in claim 11 in which a power line extends from said vibrators to a power supply external to the massager.

15. A portable massager comprising:

a. an elongated resonator plate, said plate being substantially rigid and including a plurality of contiguous hollow flutes oriented in a longitudinal direction, said plate further including a pair of vibrator cutouts passing from an upper side to a lower side thereof;

b. a pair of electric vibrators, said vibrators being sized and configured to fit within said cutouts of said resonator plate, each of said vibrators having a lower face and an upper face;

c. a lower sheet of foam, said lower sheet covering said lower side of said resonator plate and supporting said lower faces of said vibrators;

d. an upper sheet of foam, said upper sheet covering said upper faces of said vibrators and at least a portion of said upper side of said resonator plate; and, e. a top cover co-extensive with and covering said upper sheet and said upper side of said resonator plate, and a bottom cover co-extensive with and covering said lower sheet, said top cover and said bottom cover including peripheral edges connected to form a peripheral seam.

16. A massager as in claim 15 in which said resonator plate is formed from a plastic material.

17. A massager as in claim 16 in which said flutes have a uniform diameter within the range of 1/16" to 1/2".

18. A massager as in claim 15 in which a power line extends from said vibrators to a power supply external to the massager and in which a vibrator control switch is provided in said power line, said vibrator control switch being located on said lower sheet and having a switch control element extending through said top cover so as to be user accessible.

19. A massager as in claim 15 having an elongated dimension and a transverse dimension so as to accommodate two feet resting thereon.

20. A massager as in claim 15 having an elongated dimension and a transverse dimension so as to accommodate two wrists resting thereon.

* * * * *